US012415126B2

(12) United States Patent
Patterson

(10) Patent No.: US 12,415,126 B2
(45) Date of Patent: Sep. 16, 2025

(54) SHABACH

(71) Applicant: Michael Isaiah Patterson, Southaven, MS (US)

(72) Inventor: Michael Isaiah Patterson, Southaven, MS (US)

( * ) Notice: Subject to any disclaimer, the term of this patent is extended or adjusted under 35 U.S.C. 154(b) by 613 days.

(21) Appl. No.: 17/862,059

(22) Filed: Jul. 11, 2022

(65) Prior Publication Data

US 2024/0009549 A1 Jan. 11, 2024

(51) Int. Cl.
*A63F 3/00* (2006.01)

(52) U.S. Cl.
CPC ..... *A63F 3/001* (2013.01); *A63F 2003/0011* (2013.01)

(58) Field of Classification Search
CPC ..... A63F 3/001; A63F 2003/0011; A63F 3/00138; A63F 3/00173; A63F 3/0023; A63F 3/00261; A63F 2003/00359
See application file for complete search history.

(56) References Cited

U.S. PATENT DOCUMENTS

2003/0227132 A1* 12/2003 Martin ..... A63F 3/00006 273/249
2008/0007000 A1* 1/2008 Rodela ..... A63F 3/00176 273/249
2009/0023117 A1* 1/2009 Johnson ..... A63F 1/00 273/299
2010/0276883 A1* 11/2010 Mack ..... A63F 3/00 273/243
2011/0031690 A1* 2/2011 Young ..... A63F 3/001 273/237
2012/0267852 A1* 10/2012 White-Sampson ..... A63F 3/001 273/242
2014/0062020 A1* 3/2014 Jacob ..... A63F 3/001 273/242
2015/0258421 A1* 9/2015 Craig ..... A63F 3/00006 273/249
2023/0149796 A1* 5/2023 Noble ..... A63F 3/00697 273/269
2023/0256323 A1* 8/2023 Barnett ..... G09B 19/00 273/292

* cited by examiner

*Primary Examiner* — Omkar A Deodhar

(57) ABSTRACT

A master game board comprising a plurality of 49 cell spaces aligned in vertical columns and horizontal rows that embody color schemes, biblical indicia, definable alphabets, and a game title. The callout markers are detachably affixed to the master game board, and randomly called out until a winner is declared. The game cards mirror the master game board with the exception of the chronologically placement of the biblical indicia, the winning diagrams, and the callout markers. All game cards embody identical biblical indicia randomly designated on cell spaces allowing for concurrent learning engagement among players without a loss of turn during game play. The game cards are affixed with detachable cell space markers that are placed on the surface of individual cell spaces that have answers corresponding to called out entries. Unused callout markers, at the end of a game, are firstly used in a new game.

9 Claims, 8 Drawing Sheets

Fig. 11

32

| S | H | A | B | A | C | H |
|---|---|---|---|---|---|---|
| S-45 GOD | B6 Joshua | B30 Amos | B29 Joel | B14 2 Chronicles | B7 Judges | S-48 OMEGA |
| B8 Ruth | B1 Genesis | B26 Ezekiel | G-43 ISRAEL | G42 JACOB | B34 Nahum | B32 Jonah |
| B37 Haggai | B28 Hosea | B21 Ecclesiastes | B15 Ezra | B38 Zechariah | B12 2 Kings | B39 Malachi |
| B36 Zephaniah | G-40 ABRAHAM | B4 Numbers | SHABACH | B33 Micah | G-41 ISAAC | B19 Psalm |
| B35 Habakkuk | B20 Proverbs | B10 2 Samuel | B27 Daniel | B25 Lamentations | B17 Esther | B23 Isaiah |
| B5 Deuteronomy | B16 Nehemiah | B13 1 Chronicles | E-44 MOSES | B9 1 Samuel | B3 Leviticus | B24 Jeremiah |
| S-47 ALPHA | B11 1 Kings | B31 Obadiah | B18 Job | B2 Exodus | B22 Song of Solomon | S-46 I AM |

S=SOVEREIGN G=GENESIS E-EXODUS B=BOOKS OF THE BIBLE

32

| S | H | A | B | A | C | H |
|---|---|---|---|---|---|---|
| S-45 GOD | B5 Deuteronomy | B13 1 Chronicles | B6 Joshua | B19 Psalm | B31 Obadiah | S-48 OMEGA |
| B39 Malachi | B21 Ecclesiastes | B34 Nahum | G-43 ISRAEL | B11 1 Kings | B20 Proverbs | B14 2 Chronicles |
| G42 JACOB | B9 1 Samuel | B23 Isaiah | B24 Jeremiah | B38 Zechariah | B1 Genesis | B18 Job |
| B4 Numbers | G-40 ABRAHAM | B3 Leviticus | SHABACH | B7 Judges | G-41 ISAAC | B37 Haggai |
| B30 Amos | B16 Nehemiah | B28 Hosea | B12 2 Kings | B8 Ruth | B35 Habakkuk | B26 Ezekiel |
| B15 Ezra | B27 Daniel | B36 Zephaniah | E-44 MOSES | B33 Micah | B22 Song of Solomon | B25 Lamentations |
| S-47 ALPHA | B10 2 Samuel | B17 Esther | B2 Exodus | B29 Joel | B32 Jonah | S-46 I AM |

S=SOVEREIGN G=GENESIS E-EXODUS B=BOOKS OF THE BIBLE

FIG. 12
(detached upper game card reference 36 of FIG. 2)

28

32

34

| S | H | A | B | A | C | H |
|---|---|---|---|---|---|---|
| SHA BACH | B6 Joshua | B30 Amos | B29 Joel | B14 2 Chronicles | B7 Judges | SHA BACH |
| SHA BACH | SHA BACH | B26 Ezekiel | G-43 ISRAEL | G42 JACOB | B34 Nahum | SHA BACH |
| SHA BACH | B28 Hosea | SHA BACH | B15 Ezra | B38 Zechariah | B12 2 Kings | SHA BACH |
| SHA BACH | G-40 ABRAHAM | B4 Numbers | SHA BACH | B33 Micah | G-41 ISAAC | SHA BACH |
| SHA BACH | B20 Proverbs | B10 2 Samuel | B27 Daniel | SHA BACH | B17 Esther | SHA BACH |
| SHA BACH | B16 Nehemiah | B13 1 Chronicles | E-44 MOSES | B9 1 Samuel | SHA BACH | SHA BACH |
| SHA BACH | B11 1 Kings | B31 Obadiah | B18 Job | B2 Exodus | B22 Song of Solomon | SHA BACH |

S=SOVEREIGN G=GENESIS E-EXODUS B=BOOKS OF THE BIBLE

28

32

34

| S | H | A | B | A | C | H |
|---|---|---|---|---|---|---|
| SHA BACH | SHA BACH | SHA BACH | SHA BACH | SHA BACH | SHA BACH | SHA BACH |
| B8 Ruth | B1 Genesis | B26 Ezekiel | G-43 ISRAEL | G42 JACOB | B34 Nahum | B32 Jonah |
| B37 Haggai | B28 Hosea | B21 Ecclesiastes | B15 Ezra | B38 Zechariah | B12 2 Kings | B39 Malachi |
| B36 Zephaniah | G-40 ABRAHAM | B4 Numbers | SHABACH | B33 Micah | G-41 ISAAC | B19 Psalm |
| B35 Habakkuk | B20 Proverbs | B10 2 Samuel | B27 Daniel | B25 Lamentations | B17 Esther | B23 Isaiah |
| B5 Deuteronomy | B16 Nehemiah | B13 1 Chronicles | E-44 MOSES | B9 1 Samuel | B3 Leviticus | B24 Jeremiah |
| SHA BACH | SHA BACH | SHA BACH | SHA BACH | SHA BACH | SHA BACH | SHA BACH |

S=SOVEREIGN G=GENESIS E-EXODUS B=BOOKS OF THE BIBLE

FIG. 13

(detached upper half of master game board reference 30 of FIG. 1)

| S | H | A | B | A | C | H |
|---|---|---|---|---|---|---|
| S-45 GOD | B6 Joshua | B12 2 Kings | B19 Psalm | B23 Isaiah | B30 Amos | S-40 OMEGA |
| B1 Genesis | B7 Judges | B13 1 Chronicles | G-13 [illegible] | B24 Jeremiah | B31 Obadiah | B36 Zephaniah |
| B2 Exodus | B8 Ruth | B14 2 Chronicles | B20 Proverbs | B25 Lamentations | B32 Jonah | B37 Haggai |
| B3 Leviticus | G-11 ABRAHAM | B15 Ezra | SHADRACH | B26 Ezekiel | G-12 ISAAC | B38 Zechariah |
| B4 Numbers | B9 1 Samuel | B16 Nehemiah | B21 Ecclesiastes | B27 Daniel | B33 Micah | B39 Malachi |
| B5 Deuteronomy | B10 2 Samuel | B17 Esther | S-44 [illegible] | B28 Hosea | B34 Nahum | 042 JACOB |
| S-47 ALPHA | B11 1 Kings | B18 Job | B22 Song of Solomon | B29 Joel | B35 Habakkuk | S-46 I AM |

S=SOVEREIGN G=GENESIS E=EXODUS B=BOOKS OF THE BIBLE

24

2

24

20

(detached upper game card reference 36 of FIG. 2)

(detached upper game card reference 36 of FIG. 2)

SHABACH

BACKGROUND OF THE INVENTION

A board game apparatus, similar to Bible bingo-type games, comprising an entertainingly method of game play that simultaneously heightens the potential, and ability of single and multiple players to learn and memorize the books of the Bible. In particular a board game consisting of Bible game playing articles collectively utilized during game play to entertainingly teach of biblical documentation and presents a simplified method of game play for all participating players to concurrently learn and memorize the books of the Bible.

To heighten the learning, interests, and entertainingly teach of various documentations of the Bible, Bible board games have been devised for such objectives aforementioned. For example, U.S. Pat. No. 20060267280A1 discloses a Bible Bingo game that employs a board game comprised of game cards with adjacent square spaces on the surface having biblical indicia that randomly vary on each game card of which incorporates a method of game play relative to BINGO U.S. Pat. No. 2,322,324. Bible Bingo is a game of chance embodying a plurality of game cards that, individually, have different and similar random answers on the surface of the square spaces that correspond to answers printed on callout game cards. Each player is given a game card that has one of the letters of BINGO at the top of the question and answer on the game card. Bible game pieces, and a playing board is also given to the participants to begin the game. A caller will call out the question from a callout card. If a player has the answer on their board that corresponds to the answer and the appropriate letter in the word BINGO printed on their perspective card, they may mark the correct answer on their board using game pieces that are in the form of a Bible. The first player to attain a winning configuration and shouts BINGO wins the game.

U.S. Pat. No. 6,547,245B1 discloses an apparatus comprising a board game having a plurality of Bible indicia, religious, and colored game spaces printed along a path on the surface of a game board having a start and an end. Sequentially, each player will be given a turn to roll a set of dice. The number revealed by the dice indicates the number of spaces a player can move along the game board with their token. Each space on the game board corresponds to 1 of 3 sets of cards of which are scripture cards, special cards, and player cards. To select a card from one of the three card decks is contingent upon the position of the players individual token on a space of the game board after a roll of dice. For example, if a player move their token as indicated by the number revealed on a set of dice rolled, and the space of which they move to has a Bible indicia, a player must select a card from the deck of scripture cards and answer the question thereon, and complete the action printed on the scripture card. If the player cannot answer the question on the scripture card, they cannot initiate the action on the scripture card that prompts a player to move along the game board with his/her token. Therefore they cannot proceed to another space on the game board. Afterwards, while the player token is temporarily stationary, the player must search for the answer in the reference book of the board game, locate and memorize the answer, and quote the answer during his/her next turn at game play. If the correct answer is given, the player will be able to complete the action printed on the scripture card of which will allow the player to move forward unto another space on the game board. Meanwhile, the other participating player(s) may, sequentially, proceed with their turn at game play and provide the answer to the question of a selected card of one of the three sets of game cards that correspond to the space where their individual token is positioned. Each player may proceed to move forth along the spaces on the game board according to the correct answer that is given corresponding to the perspective card that is selected.

Likewise, if any one of the participating players answer their perspective question of the selected card incorrectly, his/her token will remain temporarily stationary on a space of the game board until their next turn at game play of which they must search the reference book, memorize, and proclaim the correct answer to move further along the game board. The game is won by being the first player to move their token to the finish space.

Although the aforementioned patents present an entertainingly apparatus for motivating and encouraging persons to memorize versus of the Bible, and to learn of GOD's commands they do not provide a method of game play that will allow all participants to actively engage simultaneously and uniformly learn of the biblical content concurrently during game play. The prior art embodies biblical indicia, and information printed on the surface of the participants game playing articles that vary on each individual game card for each player, thus, invariably, creating a loss of turn for a player(s) and a stifled opportunity for all participants to learn and memorize the answers to the questions collectively during game play.

Therefore, in the context of learning the books of the Christian Bible, and documentation pertaining to the Bible there is a need for an educational board game that embodies a method of game play that entertainingly promotes the learning of the books of the Bible and biblical content through simultaneous engagement of all participating players at once without a loss of turn during game play. The present embodiment, during game play, equally provides an opportunity for all participants to learn and memorize biblical content concurrently.

The present embodiment further presents a board game with a master game board and a plurality of game cards with affixed cell space markers. The entirety of the board game playing articles can be efficiently manufactured, economically produced, and promptly distributed among participants before the start of a game to minimize the time necessary to initiate game play.

SUMMARY

The inherent disadvantages aforementioned in the known board games of the prior art are noticeably visible in the detailed instructions of the prior art's method of game play. The present invention has many of the advantages of the prior art and incorporates a newly devised apparatus and method of game play that is uniquely novel and non-obvious. Thus, the present invention embodies a new entertainingly educational game for learning the books of the Bible and biblical related content.

The present invention is a board game devised for the purposes of providing a family oriented biblical board game of entertainment that embodies a method of game play that provides an opportunity for children and adults to concurrently learn and memorize biblical persons, places, things, and books of the Bible throughout game play without a loss of turn. It comprises a planar master game board having a plurality of cell spaces printed with biblical indicia for the purposes of keeping a record of the called out entries which are rectangular callout markers.

The present invention also encompasses a plurality of game cards (only one shown) individually having an equal number of horizontal rows and vertical columns embodying a matrix of adjacent cell spaces numerically embodying random biblical indicia designated on the playing surface of the game cards.

Affixed to the players game cards are square cell space markers that are detached prior to the start of a game which are used for marking an answer on a designated cell space, corresponding to a callout marker.

Further details of the present invention and a thorough explanation of how to use the newly formed apparatus and method of game play will be specifically expressed in the section of the details of the invention.

BRIEF DESCRIPTION OF THE DRAWINGS

FIG. 11 is a representation of the upper half of game cards 32 illustrating the embodiment of identical biblical indicia that are stationary on the surface of nine unique color cell spaces and each game card having identical biblical content uniquely distinguished by a random placement of an embodiment of a combination of letters, numbers, words, and biblical indicia within the cell spaces on the surface of the player's individual game card.

FIG. 12 is an illustration of the vertical, horizontal, and diagonal winning diagrams that can be achieved during game play.

FIG. 13 illustrates the center call out marker 24 of the upper half of the master game board called out and marked on the center cell space 20 independently.

DETAILED DESCRIPTION OF THE INVENTION

The description of the embodiment of the present invention and its' entirety is not intended to be limited by the descriptive illustrations of the drawings, terminology, and objectives of the application of the present invention. It is to be further understood that the newly devised apparatus illustratively introduces an entertaining method of game play for learning the books of the Christian Bible that is capable of being modified into various embodiments that may express the current apparatus in multiple ways without deviating from the principles of the invention. The illustrations of the drawings and the specifications presents a simplified approach to the procedure of the present invention that those that are skilled in the art will realize the potential of how to optimize the embodiments of the present invention beyond the specifications within the scope of the principles of the board game.

Figure 1:
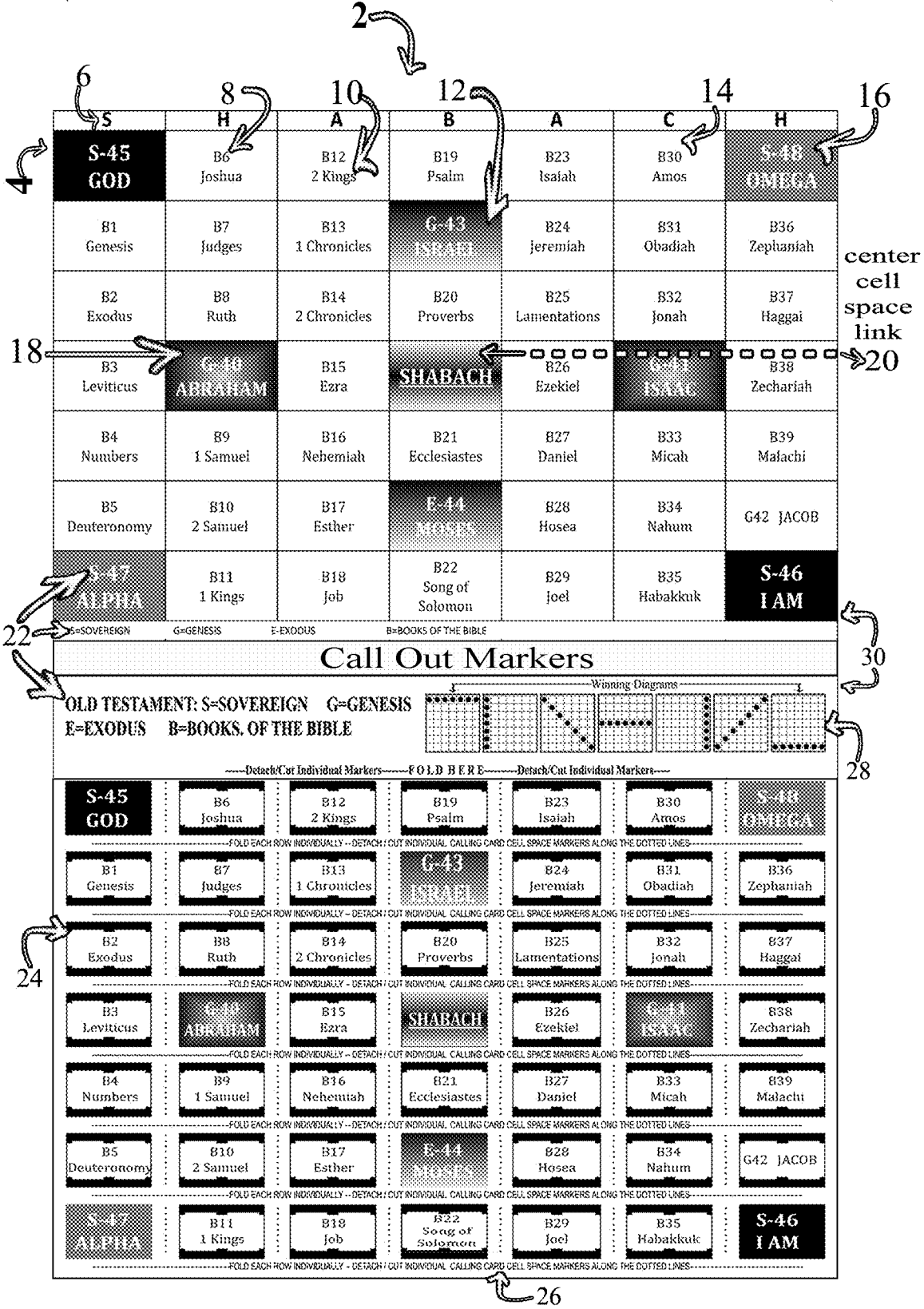
FIG. 1 is a top plan view of the board game 2 illustrating the master game board 4 having a plurality of cell spaces, biblical indicia, single and two color scheme cell spaces, and an equal number of horizontal rows and vertical columns. The title of the game is printed in a single top header. Callout markers are affixed to the master game board with alphabets defined, winning diagrams, and how-to-instructions of the procedure of how to detach game board callout markers.
Figure 8:
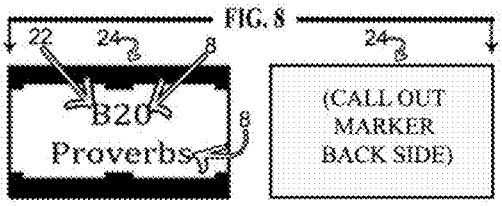
FIG. 8 is a front and rear view of a call out marker with biblical indicia.
Figure 10:
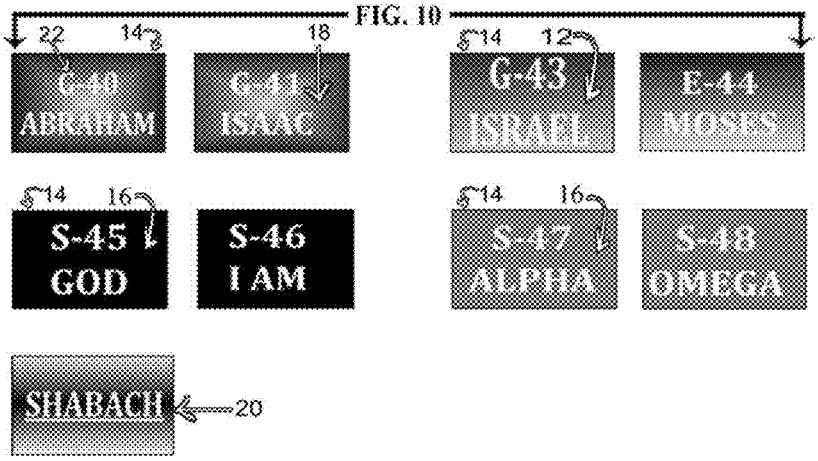
FIG. 10 is a representation of nine stationary unique cell spaces with printed single color and two color schemes blue, green, yellow and white, and red and white embodied with biblical indicia on both the master game board 4 and the game card 32.

Referring to the preferred embodiment FIG. 1 a board game 2 comprising a master game board referenced by the numeral 4 illustrating a top plain view embodying a top header with a game title 6, seven horizontal rows and seven vertical columns, and a planar playing surface consisting of a matrix of adjacently aligned rectangular cell spaces 14 which mirrors the conveniently affixed 30 rectangular callout markers 24 that are illustrated in FIG. 8. Cell spaces 14 embody a Bible book number 8, a Bible book name 10, an alphabet, a biblical name, and a biblical title 22, of which, collectively, are biblical indicia representing biblical definitions 22, answers that correspond to callout markers 24, and 39 old testament books of the Christian Bible printed on the surface of the master game board 4, and the player's game cards 32 (only one shown). The 27 new testament books of the Bible are not shown in the drawings. The dimensions of the board game 2 playing members FIG. 1 and FIG. 2, and the method of game play, further explained in the description, are identically the same for the 27 new testament books of the Bible dissimilar only to the biblical indicia printed on the surface of the cell spaces 14, the biblical definitions 22, and the call out markers 24. FIG. 10 illustrates a set of nine stationary unique cell spaces 14 with stationary biblical indicia on the master game board 4 and the game cards 32. The cell spaces 14 mirrors the affixed 30 callout markers 24 embodying identical matching pairs of single colors 16 of blue, green, and matching pairs of two color schemes 12 of yellow and white, red and white 18, and a single center cell space 14 color scheme blue and yellow 20 located in the center of the master game board 4 and the player's game card 32 that is marked to validate the relativity of the biblical indicia of two identical single 16, and two identical two color scheme 12, 18 cell spaces 14 during game play. Affixed 30 at the bottom half of the master game board 4 are callout markers 24, detachment instructions 26, and winning diagrams 28. The dimensions of the rectangular master game board 4, and the rectangular game card 32 are dimensionally identical as shown in FIG. 3 of which illustrates the rear top view, and an elevated top view FIG. 4. FIG. 5 is an elevated bottom view.

FIG. 6 is an elevated left side view, and FIG. 7 is an elevated right side view.

Figure 2:
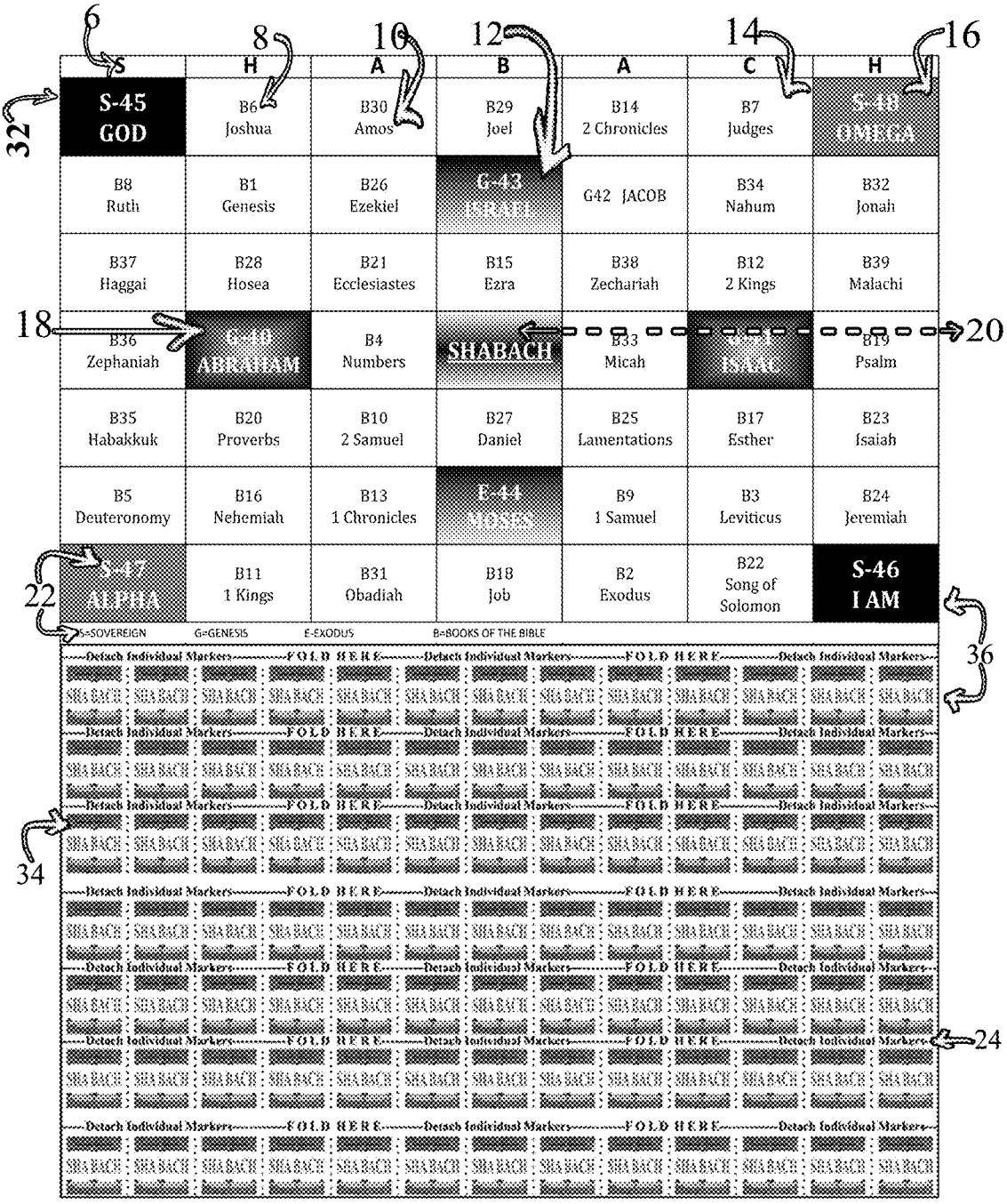
FIG. 2 is an illustrated top plan view of a player's game card 32 having a plurality of cell spaces embodying biblical indicia, single and two color scheme cell spaces on the surface of an equal number of horizontal rows and vertical columns. The title of the game is printed in a single top header of the game card. The bottom-header of the upper half of the game card illustrates alphabets that are defined. Cell space markers having biblical indicia are affixed to the game card with how-to-instructions of the procedure of how to detach cell space markers.
Figures 3, 4, 5, 6, 7:
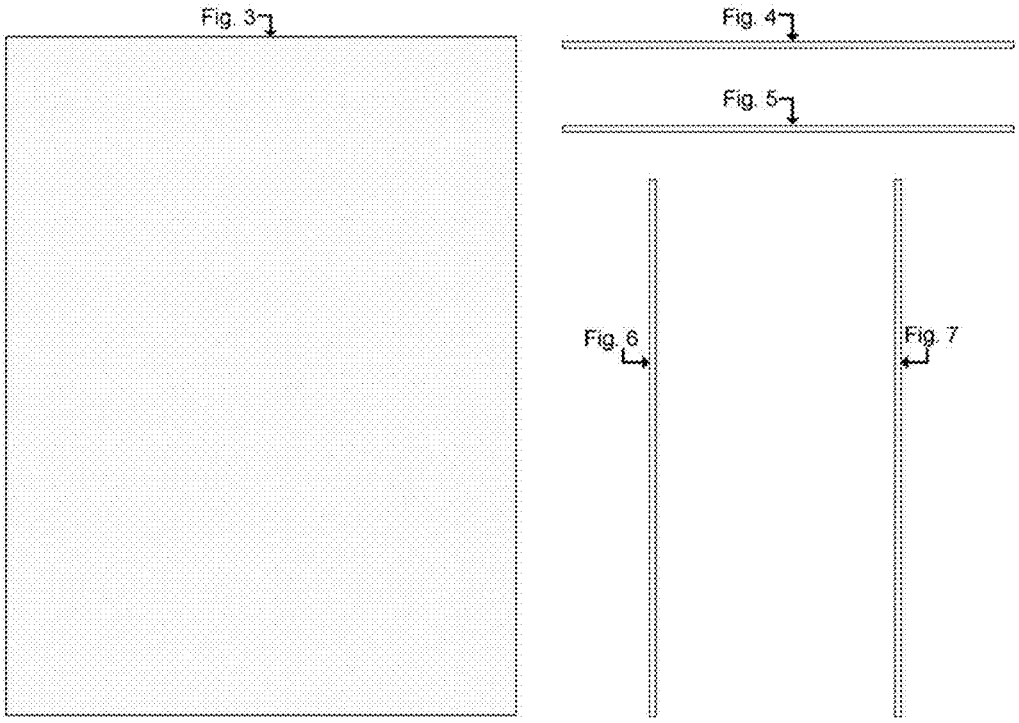
FIG. 3 is an illustrated rear plan view of FIG. 1 and FIG. 2.
FIG. 4 and FIG. 5 are representations of an elevated top and bottom view of both FIG. 1 and FIG. 2
FIG. 6 and FIG. 7 are representations of an elevated left and right view of both FIG. 1 and FIG. 2.
Figure 9:
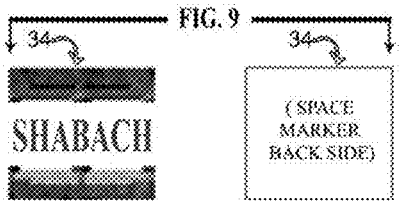
FIG. 9 is a front and rear view of a cell space marker with biblical indicia

Referring to FIG. 2 a game card 32 mirrors the master game board 4 with the exception of the sequentially chronological positioning of the biblical indicia printed on the surface of the cell spaces 14, the affixed 30 callout markers 24, and the winning diagrams 28. In further detail, each game card 32, numerically, has identical biblical indicia markings randomly located within the cell spaces 14 on the surface of each individual game card 32. The bottom half of the game card 32 is conveniently affixed 36 with square cell space markers 34 having a biblical indicia SHABACH thereon the surface as illustrated in FIG. 9 showing a top and rear plain view of a cell space marker 34. The affixed 36 cell space markers 34 are detached 24 from the lower bottom half of the game card 32 prior to game play for the purposes of marking corresponding answers that are located within the cell spaces 14 on the playing surface of each individual game card 32.

FIG. 11 illustrates the upper top half of two random game cards 32 having numerically identical printed biblical indicia randomly located on the playing surface of the cell spaces 14. The two game cards 32 illustrate the uniqueness of each individual game card 32 of which allows for each participating player to engage in the fun of learning the books of the Bible simultaneously during game play without a loss of turn due to the limitations noted in the prior art whereas an individual player who lacks the knowledge necessary to respond with an answer to a particular question printed on a set of playing cards, a game card, or a game board will be delayed in progressing during the game. Thus, stifling the fun of consistent and active engagement among players during game play, and limiting the ability of various participating players to learn of the content of the game concurrently.

FIG. 12 illustrates the winning diagrams vertical, horizontal, and diagonal 28 that can be achieved during game play using the affixed 36 cell space markers 34 of which, corresponding to the callout markers 24, are used to mark the answers on the game card 32.

Figure 14:
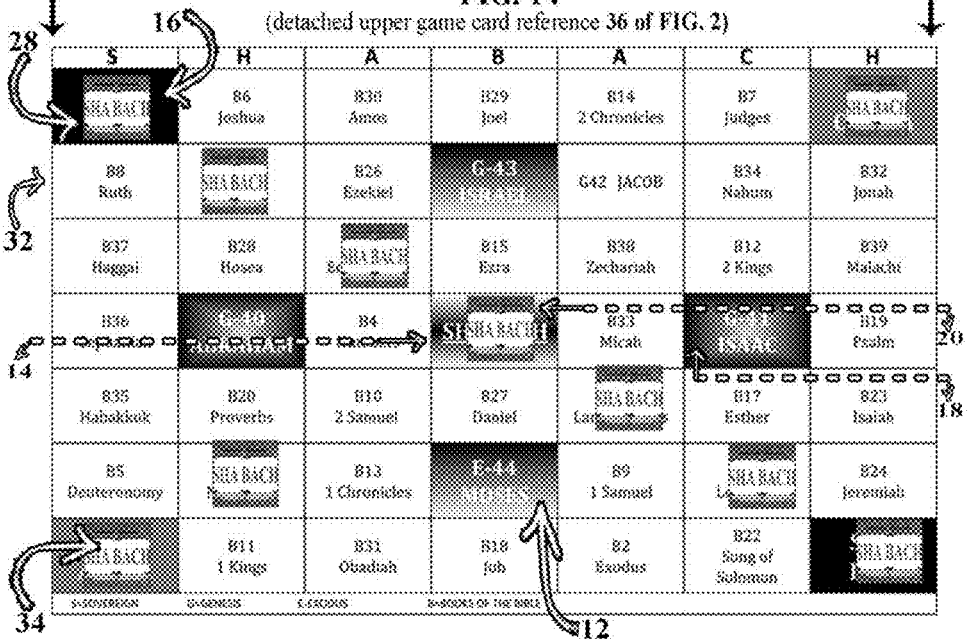
FIG. 14 is a representation of the front view of the upper half of a game card illustrating the center cell space dependently marked corresponding to an answer that is marked on the surface of a single color 16 cell space 14.
Figure 15:
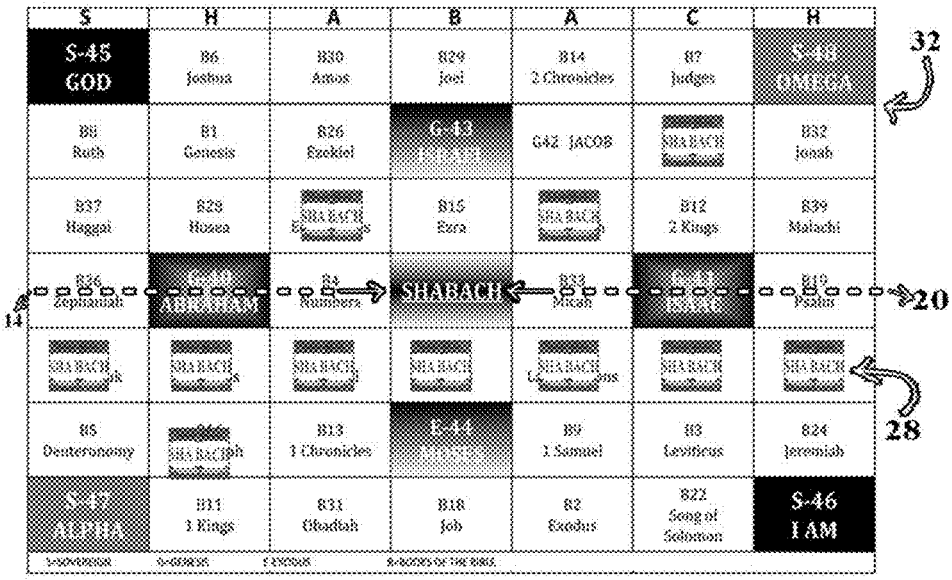
FIG. 15 illustrates the front view of the upper half of a game card whereas the center cell space is not automatically marked as a free cell space prior to, or during game play.

FIG. 13 illustrates the placement of the center cell space callout marker 24, having a biblical indicia marking SHABACH, called out and marked independently on the surface of the master game board 4 in its' designated cell space 14 prior to an announcement of any two identical single color 16, or identical two color scheme 12, 18 cell spaces 14 shown in FIG. 13. Any one unique color cell space of an identical matching pair of unique color 12, 16, 18 cell spaces 14 that is announced by the game host and marked on a player's game card 32, thereafter the single two color scheme 20 center cell space 14 has been marked, will be automatically validated as having relatively inseparable biblical indicia in conjunction with the matching identical individual unique color 12, 16, or 18 cell space 14 which is also marked being parallel to the aforementioned cell space. FIG. 14 illustrates a game card 32 with two matching pairs of single color 16 FIG. 10 cell spaces 14 that are both marked, corresponding to callout markers, and validated with a cell space marker 34 positioned on the two color scheme 20 center cell space 14 of the game card 32 to validate the inseparable relationship of biblical indicia on the surface of any two identical single color 16, or two color scheme 12,18 cell spaces 14 as shown in FIG. 14. FIG. 15 illustrates a game card 32 with a horizontal winning diagram 28 whereas the color scheme 20 of the center cell space 14 has not been marked with a cell space marker 34 being that it is not an automatically freely marked center cell space 14 during game play. The color scheme 20 of the center cell space 14 is only marked independently when corresponding to a callout marker 24, or dependently marked in conjunction with a matching pair of unique cell spaces to validate the inseparable relationship of biblical indicia on the surface of any two identical unique single color 16, or two color scheme 12, 18 cell spaces 14 that are marked corresponding to a callout marker 24.

Rules of the Game

A game host begins the game by distributing game cards 32 to each individual participating player. The game host will detach 26 the affixed 30 callout markers 24 from the master game board 4, and the players will detach 24 the affixed 36 cell space markers 34 from their individual game card 32. The game host will place the callout markers 24 on a flat surface, or in a suitable holding container. The host will then intermix the callout markers 24, and proceed to randomly chose a callout marker 24 to call out to the players. The callout marker 24 is placed on a designated cell space 14 of the master game board 4. In response to the individual callout markers being announced, the participating players will, concurrently, mark the corresponding answer on the designated cell space 14 of their individual game card 32 simultaneously during game play The unique stationary single color 16 cell spaces 14, and the unique stationary two color scheme 12, 18 cell spaces 14 are individual matching pairs. Each individual matching pair of color cell spaces embodies biblical indicia that are inseparably relative in content toward one another. E.g., FIG. 2 illustrates the relationship of the biblical indicia of the single color 16S-47 ALPHA and S-48 OMEGA 16 designated on the surface of their perspective cell space 14 of which are name titles 22 of GOD mentioned in Revelation 22:13 of the Holy Bible as "the beginning (S-47 ALPHA) and the end (S-48 OMEGA)."

When the game host randomly selects, and calls out one single color 16, or a two color scheme 12, 18 call out marker 24, the players must use their cell space markers 34 to mark both the answer on the surface of the unique color cell space 14 that corresponds to the call out marker 24, and dependently mark the matching unique color cell space 14 of the said pair wherein they are parallel one to another having inseparably relatively biblical indicia. Additionally, the color scheme 20 of the center cell space 14, is dependently marked in conjunction with unique colored 16, 12, 18 cell spaces 14 as it is positioned centrally to validate the relationship between any two, or more identical matching pair of single color 16, and two color scheme 12, 18 cell spaces 14 with inseparably relative biblical indicia that are parallel to one another. The game host may also call out the color scheme 20 callout marker 24, of which will be marked on the surface of the center cell space 14 of a player's individual game card 30 independently without a single color 16, or two color scheme 12, 18 cell space 14 being announced, or marked. The color scheme 20 cell space 14 is only marked independently when a dedicated callout marker 24 is called out prior to the marking of a unique color cell space. The color scheme 20 can also be dependently marked to validate the relationship of biblical indicia on the surface of any two, or more identical individual matching pairs of solid colors 16, and two color schemes 12, 18 that are marked corresponding to a callout marker 24.

When the game host announces a callout marker 24, each player will be able to mark a corresponding answer on the surface of the designated cell space 14 of their individual game card. Excluding the stationary unique colored FIG. 10 cell spaces 14, the biblical indicia of its' perspective cell space 14 that corresponds to the entry called out will be located in a different area of the matrix of cell spaces 14 on each individual player's game card 32. This enables everyone to have the same opportunity to mark a cell space 14 in a different location on their perspective game card 32 during game play.

Thus, enabling all participating players to learn of the books of the Bible simultaneously while having fun being entertained by the method of game play that provides the optimum opportunity to win without the restrictions of losing a turn during game play as aforementioned in the background of the invention section pertaining to the prior art. The game host will continue to announce the callout markers, and mark the entries on the surface of their designated cell space 14 of the master game board 4 until a player(s) has attained a winning diagram 28 on their perspective game card 32 and shouts the word SHABACH. The placement of the cell space markers 34 on the surface of the answers of the proclaimed winning game card 32 will be proofed for accuracy by the game host according to the entries placed on the master game board 4 to validate the answers on the player's game card 32 and the completion of one of the winning diagrams 28.

If an individual player whom shouts the word SHABACH is not declared a winner of the game by reason of insufficient proof, the game will resume until a winner is declared and validated by the entries on the master game board 4.

When a player is declared the winner of a game, the entries on the master game board 4 will be removed, intermixed, and kept separate from the callout markers 24 that were not called out during game play. The players will also remove their cell space markers 34 from their individual game card 32. The remaining callout markers 24 that were not called out during the previous game will be the first callout markers 24 to be announced in the beginning of a new game. Thereafter the said separate entries will be announced. This method will assure that all callout markers are announced for the purposes of learning and memorizing, by familiarity, all the biblical answers designated on the cell spaces 14 of each individual player's game card 32.

The present invention presents a method of game play that is simplistic and comprehensible for all participants to learn of the biblical content that is introduced during game play. E.g., if only fourteen callout markers were called out, and a player is declared the winner, all participating players would have enjoyed the same opportunity to become acquainted with the names of the fourteen books of the Bible during game play.

It has been descriptively illustrated that the preferred embodiment provides an opportunity that enables participating individuals of the board game to learn of the biblical documentation of the Bible simultaneously and concurrently throughout the course of game play without the restrictions of having to acquire a higher level of knowledge and skill of biblical content to enjoy the game, or lose a turn during game play due to the variableness of miscellaneous biblical answers only available to participants randomly of which stifles the progression of the participating players to learn concurrently and lessens the effectiveness of a game devised to promote the learning and the memorization of the books of the Bible.

Uniquely, the master game board is affixed with rectangular callout markers 24. Likewise, the game cards 32 (only one shown), uniquely, are affixed with rectangular cell space markers which are game pieces 34 that are inexpensively manufactured and are economically produced. The printing materials are environmentally friendly, and biodegradable. Game playing articles of the board game can easily be produced using home printers. Therefore, the player's game cards are independent of the need to add additional game pieces, or develop additional playing articles to necessitate the start of a game. Thus, they can be efficiently distributed to the participants minimizing the time and preparation that is needed to start game play. Therefore, the present invention promotes and heightens engagement and excitement among players for learning and memorizing the books of the Bible simultaneously for all players toward the winning of the game.

The invention claimed is:

1. A board game comprising:

a rectangular shaped master game board having an upper formed planar playing surface;

a master game board planar surface embodies a top header with title, an equal number of adjacently aligned vertical columns and horizontal rows having a matrix of adjacently aligned rectangular cell spaces embodying distinct biblical indicia sequentially and chronologically printed on the surface of the master game board;

a matrix of cell spaces individually embodying a distinct Bible book number, a Bible book name, an alphabet, a biblical name, and a biblical title which are biblical indicia representing biblical definitions that are printed on the bottom header of the master game board;

a plurality of detachably rectangular callout markers affixed to the master game board;

a plurality of rectangular shaped game cards numerically having identical biblical indicia on an upper formed planar playing surface comprising an equal number of adjacently aligned vertical columns and horizontal rows that embodies a matrix of adjacently aligned rectangular shaped cell spaces;

a set of stationary matching pairs of unique single color cell spaces and unique two color scheme cell spaces embodying stationary biblical indicia on the planar playing surface of each game card;

a unique center cell space in the center of the master game board and the game cards embodying a biblical indicia SHABACH thereon of which is marked dependently, or independently; and a plurality of detachably square cell space markers affixed to each game card having a biblical indicia SHABACH thereon the surface of each cell space marker to mark answers on the game cards.

2. A board game as defined in claim 1 wherein a matrix of adjacently aligned rectangular shaped cell spaces having distinct biblical indicia are sequentially numerated via a bible book number and chronologically designated on the playing surface of the master game board according to the chronological order of the books of the Holy Bible which are answers that correspond to callout markers.

3. A board game as defined in claim 2 wherein the master game board is affixed with detachable callout markers with distinct biblical indicia that are identical to the biblical indicia on the playing surface of the master game board.

4. A board game defined in claim 1 wherein a plurality of game cards numerically embodies identical distinct biblical indicia randomized and designated within the matrix of cell spaces on the playing surface of each individual game card which allows for the simultaneous engagement of all participating players responding to an announced callout marker without a loss of turn during game play continually.

5. A board game defined in claim 4 wherein a set of unique cell spaces embody stationary inseparably relative biblical indicia that are answers which are individually marked with a cell space marker corresponding to a callout marker.

6. A board game defined in claim 5 a unique cell space having inseparably relatively biblical indicia that is parallel to a matching unique cell space that has been marked, said cell space is marked dependently in conjunction with the matching unique cell space of the pair.

7. A board game defined in claim 6 wherein the center cell space is dependently marked, sequentially, in conjunction with a marked matching pair of unique cell spaces to validate the inseparable relativity of the biblical indicia of a matching pair of unique identical single color, or a matching pair of unique identical two color scheme cell spaces.

8. A board game defined in claim 7 wherein a center cell space is marked independently corresponding to a dedicated callout marker embodying the biblical indicia SHABACH.

9. A board game defined in claim 8 wherein a plurality of square cell space markers having a biblical indicia SHABACH are used by the players to mark the answers on their individual game card simultaneously corresponding, concurrently, to a callout marker announced.

* * * * *